United States Patent [19]

Gault

[11] 3,957,407

[45] May 18, 1976

[54] APPARATUS FOR MANUFACTURING PLASTER SHEETS

[75] Inventor: John Robert Gault, Baulkham Hills, Australia

[73] Assignee: ACI Technical Centre Pty. Ltd., Waterloo, Australia

[22] Filed: Mar. 26, 1975

[21] Appl. No.: 562,239

[30] Foreign Application Priority Data

Mar. 26, 1974 Australia ..... 7034/74

[52] U.S. Cl. ..... 425/126 R; 264/113; 425/115; 425/220; 425/DIG. 12; 425/DIG. 201

[51] Int. Cl.[2] ..... B28B 23/02

[58] Field of Search ..... 425/115, 117, 126 R, 425/220, 253, DIG. 12, DIG. 200, DIG. 201, 223; 264/108, 113, 212, 297

[56] References Cited

UNITED STATES PATENTS

| | | | |
|---|---|---|---|
| 3,506,755 | 4/1970 | Rudder et al. | 425/DIG. 201 |
| 3,661,662 | 5/1972 | Allen | 425/115 X |
| 3,849,156 | 11/1974 | Marlin et al. | 264/297 X |
| 3,861,982 | 1/1975 | Wilson et al. | 425/115 X |

*Primary Examiner*—Richard B. Lazarus
*Attorney, Agent, or Firm*—Pennie & Edmonds

[57] ABSTRACT

An apparatus is disclosed for the continuous manufacture of fiber reinforced plaster sheets which apparatus includes a conveyer for supporting a plurality of sheet casting moulds, a casting station for casting slurry into said moulds and a fiber station at which means are provided for depositing fiber for reinforcement across the surface of the casting slurry. The apparatus also includes a pair of rollers having radial extensions to force the fibers to or adjacent the lower surface of the cast slurry. A second fiber depositing means is also provided for depositing a second batch of reinforcing fibers across the surface of the slurry and a second pair of rollers having an open mesh surface are provided for forcing the second batch of fibers into the slurry to a level at or adjacent the upper surface thereof. The fibers used may be sisal or fiberglas as individual randomly oriented lengths, continuous meandering strands or a random mat deposited over the surface of the slurry.

13 Claims, 11 Drawing Figures

APPARATUS FOR MANUFACTURING PLASTER SHEETS

This invention relates to an improved method and apparatus for the manufacture of fibre reinforced plaster sheeting particularly plaster sheeting reinforced with glass fibre.

Generally plaster sheeting has been manufactured according to one of three processes.

In one method which is only suitable for small scale operation, casting of the pre-mixed plaster-water slurry is carried out on flat benches or casting tables, with steel bars placed around the edges to retain the plaster slurry while it is fluid, and to provide a surface for screeding. The bars are approximately 7/16 inch thick, which is about 1/16 inch less than the nominal thickness of the sheet which is produced. The casting tables are usually made of concrete trowelled to a high gloss, or surfaced with polyester resin. The most common size is about 40 ft. long and 7 ft. wide, and the surface of the table is usually about 2′ 6″ above floor level.

To prevent the cast from sticking to the bench, the surface is treated with a mixture of mutton fat and kerosene, or some similar type or release agent. A gauge of plaster consisting of about 100 parts plaster to 70 parts water is poured on to the table. This gauge or slurry is spread evenly over the table, and teased sisal, at the rate of about 11 oz/sq yd is shaken over the table. The fibre is incorporated into the plaster by running a fluted roller over the slurry. The overhanging edge of sisal is turned back manually, and the plaster ruled off with a screeding bar. When the sheet has hardened sufficiently, it is lifted from the table, and placed in racks to dry. In some factories, artificial driers are used to hasten this process.

In this mode of manufacture, two operators will use two such benches between them, and each bench will produce approximately one sheet per 60 minutes. Production is of the order of 14 sheets per day, or 430 sq yards per day. The effective labour productivity is hence 26.8 sq yards per man hour. At this level of productivity, labour cost sensitivity is very high and rate of production is very low.

As an alternative to the labour intensive hand casting stationary bench method, machinery capable of moving a bench beneath a stationary mixer with subsequent incorporation of a reinforcing mat in the slurry was developed.

In this alternative method of manufacture, the casting bench, which is of similar design and size to the manual bench, but is much lighter in weight, is mounted on a carrier device which runs on levelled railway tracks. The tracking system is mounted longitudinally beneath a plaster mixer. Also mounted longitudinally with respect to the bench, is an elevated mattress upon which is placed teased sisal fibre reinforcement. This mattress is geared to have the same lateral speed of travel as the casting bench.

Plaster and water in the ratio of 100 to 70 are gauged into the mixer above the casting table, the latter having been treated with surface release agent. As soon as mixing is accomplished the bench is set in motion, and the gauge is deposited longitudinally along the bench. The plaster is then levelled off by passing the bench backwards and forwards beneath a screeding bar. At this stage, the mattress and the bench motions are geared together, and the sisal reinforcement is introduced to the bench. At the same time, a roller forces the sisal into the gauge, and the sheet is then hand screeded as in the normal manual practice. After hardening the sheet is removed from the bench and dried in an oven.

In the second method of manufacture, three operators will produce about 28 sheets per day or 860 sq yds per day.

The effective labour productivity is hence 36 sq yds per man hour. This represents an improvement of almost 50% productivity on the manual casting method.

As a further alternative, a method of continuously producing paper sheathed plaster board or sheeting has been widely used throughout the world for a number of years. Basically the manufacturing line includes a continuously operated mixer which blends plaster and water in the ratio 100/70 together with a number of process additives. This mixer feeds directly on to the horizontal, inside surface of a facing liner board, which is continuously moving across a spreading table by which it is supported. The longitudinal edges of the liner board are then folded vertically upwards, to form the edges of the sheet and the face sheet, bearing the plaster slurry, is advanced to a rotating pinch-roll, which carries the backing sheet on its circumference. The pinch roll knits the slurry and backing sheet together and also serves as a thickness controlling device. The composite plaster paper sheath, is then immediately placed on an endless moving wide rubber belt approximately 380 feet in length travelling at speeds of up to 70 feet per minute. When the board reaches the end of the belt the plaster core will have set sufficiently to permit it to be pinched or cut into discrete lengths. After cutting to length the plaster boards are placed in a continuous drier where they reside for some 2–2½ hours. Automatic palleting devices remove the product from the drier after which it progresses to warehouse storage.

The crewing of such a machine would be of the order of 9 men, to the point of warehousing, and the production capacity would be of the order of 1300 sq yards of about ⅜ inch thick board per hour which is a productivity rate of 145 sq yards per man hour.

Of the three alternatives the last has proved to be the only practical and economic one where large scale operations are concerned, because of the high productivity rate in square yards per man hour. However the process suffers from some disadvantages:

a. The visual quality of the face of the products depends largely on the quality of the facing paper and also on the condition of endless rubber conveyor belt upon which the product travels during production.

b. Plaster joins between sheets of paper backed plaster are generally visible under certain types of lighting as the texture of the paper surface differs from that of the plaster join.

It is an object of the invention to provide a continuous method and apparatus for the manufacture of fibre reinforced plaster sheet which may be manufactured with or without a facing such as paper and which is suitable for operation on a large industrial scale.

For this purpose the invention provides apparatus for the continuous manufacture of fibre reinforced plaster sheet, including:

a plurality of sheet casting moulds;

endless conveying means supporting said moulds;

a casting station having slurry casting means for casting slurry into said moulds as they pass;

a fibre station, having fibre disposing means for disposing reinforcing fibres across the surface of the cast slurry and fibre forcing means to force the fibres into the slurry; and sheet removing means for removing cast sheets from the moulds.

The invention also provides apparatus for the continuous manufacture of fibre reinforced plaster sheet, including:

a plurality of sheet casting moulds each having a mould floor and a pair of side walls, adjacent moulds being joined by a flexible strip whereby to form a mould train for the casting of a continuous sheet of plaster;

a casting station having slurry casting means to cast slurry into the mould train;

a fibre station, having fibre disposing means for disposing reinforcing fibres across the surface of the cast slurry and fibre forcing means to force the fibres into the slurry;

separator means to cut the plaster sheet at the flexible strip, and sheet removing means for removing the cut plaster sheets from the moulds.

The invention also provides a continuous method for the commercial manufacture of fibre reinforced plaster sheet including the steps of:

continuously advancing a mould train along an endless conveying means;

at a casting station, casting a continuous sheet of plaster slurry into the mould train as it passes;

at a fibre station, disposing reinforcing fibre across the surface of the slurry;

forcing the fibre into the slurry;

allowing the slurry to at least partially solidify;

cutting the cast plaster into sheets;

at a removing station removing the cast sheets from the mould train; and advancing the empty moulds to the casting station.

Preferably, the reinforcing fibre is incorporated into the slurry in two stages, the first stage comprising disposing a first amount of reinforcing fibre across the surface of the slurry and rolling the first amount of fibre into the slurry such that a major proportion resides in a fibre layer in or near the region of the bottom face of the slurry, the second stage comprising disposing a second amount of reinforcing fibre across the surface of the slurry and rolling the second amount of fibre into the slurry such that a major proportion resides in a fibre layer in or near the region of the upper face of the slurry.

The fibre may be any conventional reinforcing fibre such as sisal or fibreglass in the form of individual lengths, random fibre mat or a continuous length of randomly oriented fibre. However randomly oriented individual chopped fibreglass strands or rovings having lengths of the order of ½ to 2 feet, more preferably about one foot are preferred.

The invention will now be described in more detail with reference to a preferred embodiment shown in the accompanying drawings wherein.

Figure 1:
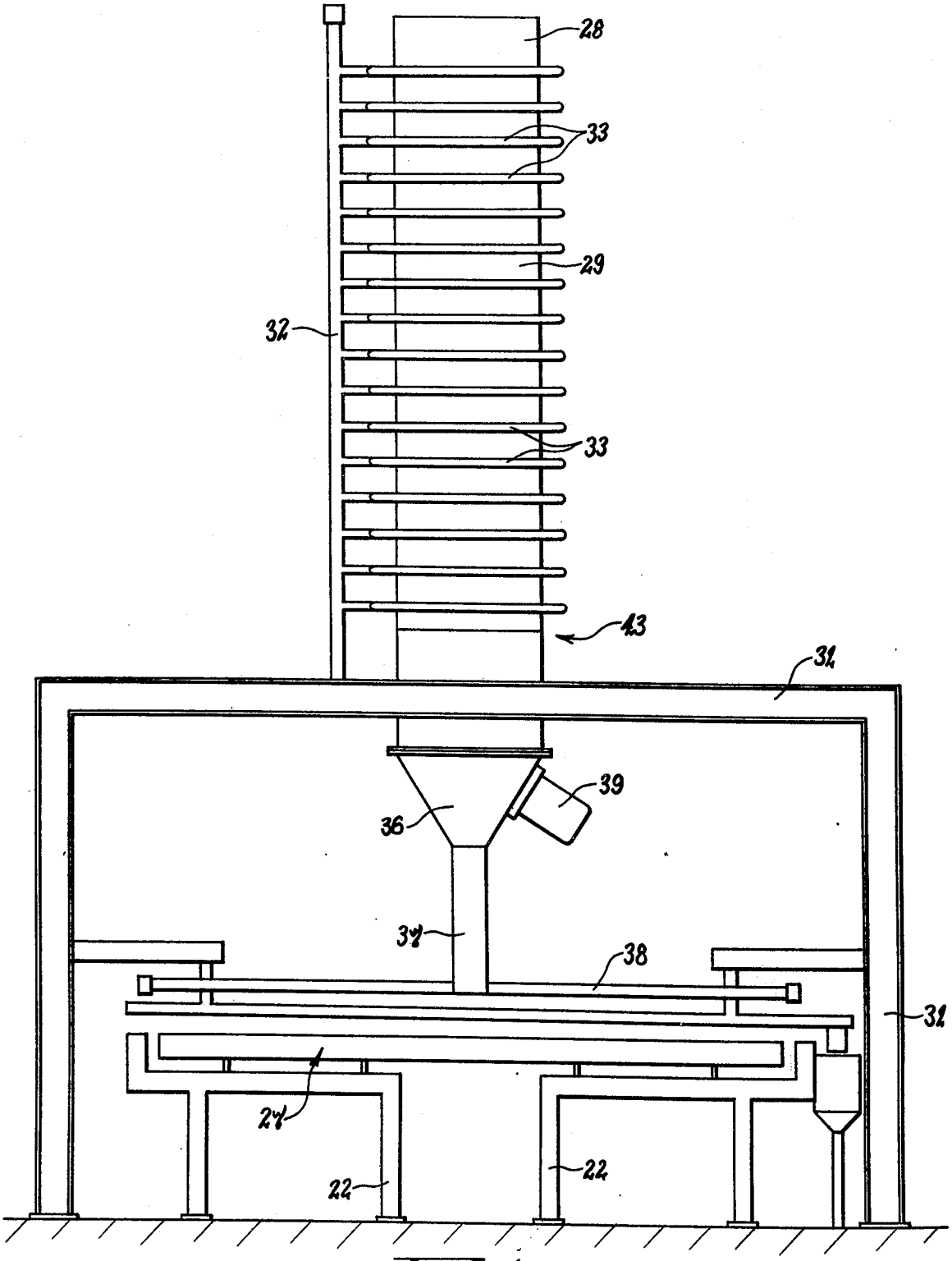
FIG. 1 illustrates a plaster and water mixing tank mounted above the mould train.
Figure 2:
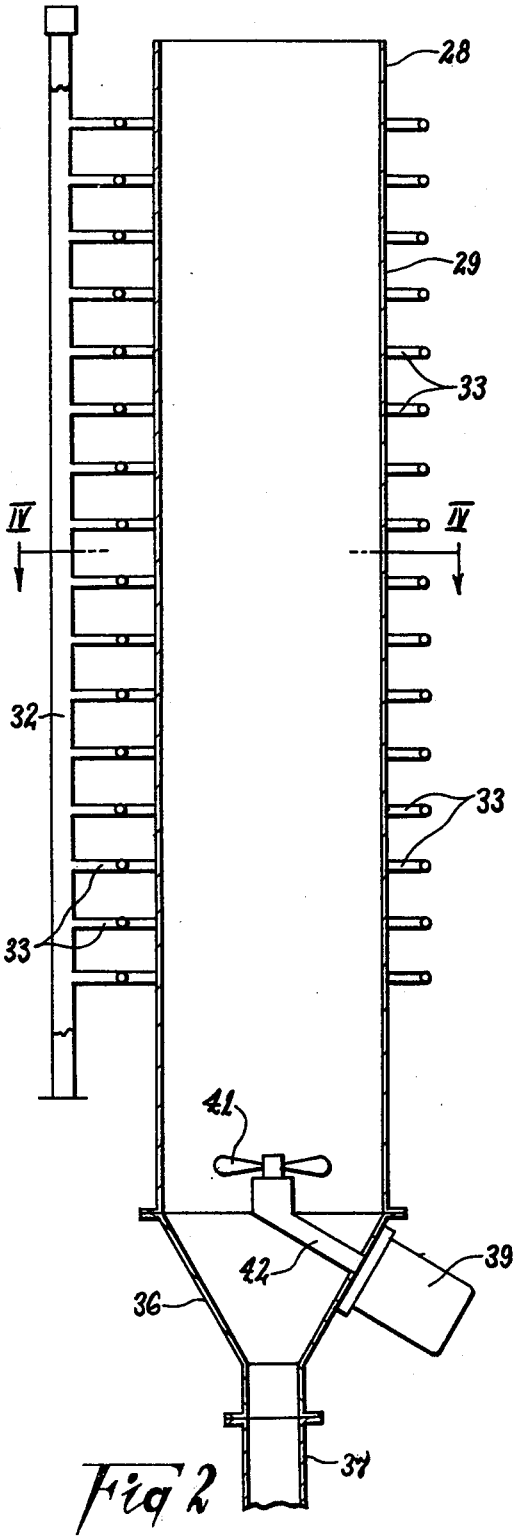
FIG. 2 shows a section through the mixing tank of FIG. 1.
Figure 4:
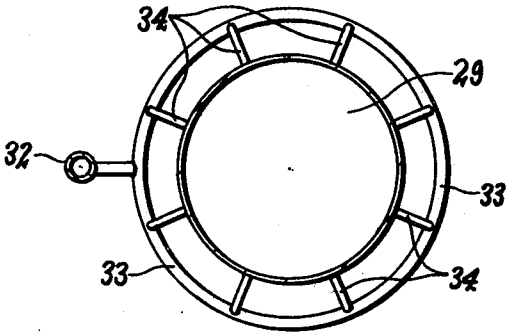
FIG. 4 shows the arrangement of spray nozzles around the mixing tank.
Figure 3:
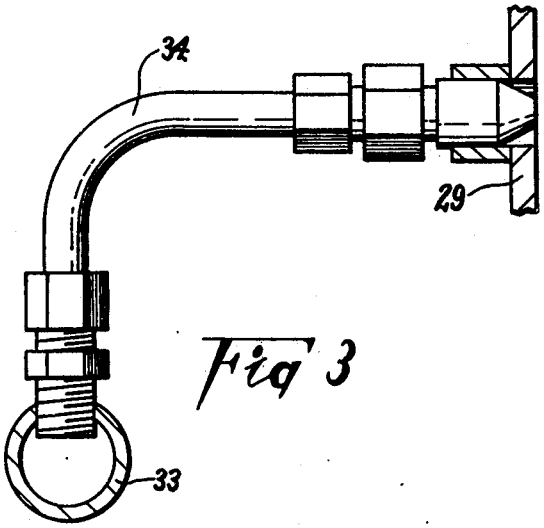
FIG. 3 illustrates a spray nozzle as used in the mixing tank of FIGS. 1 and 2.
Figure 5:
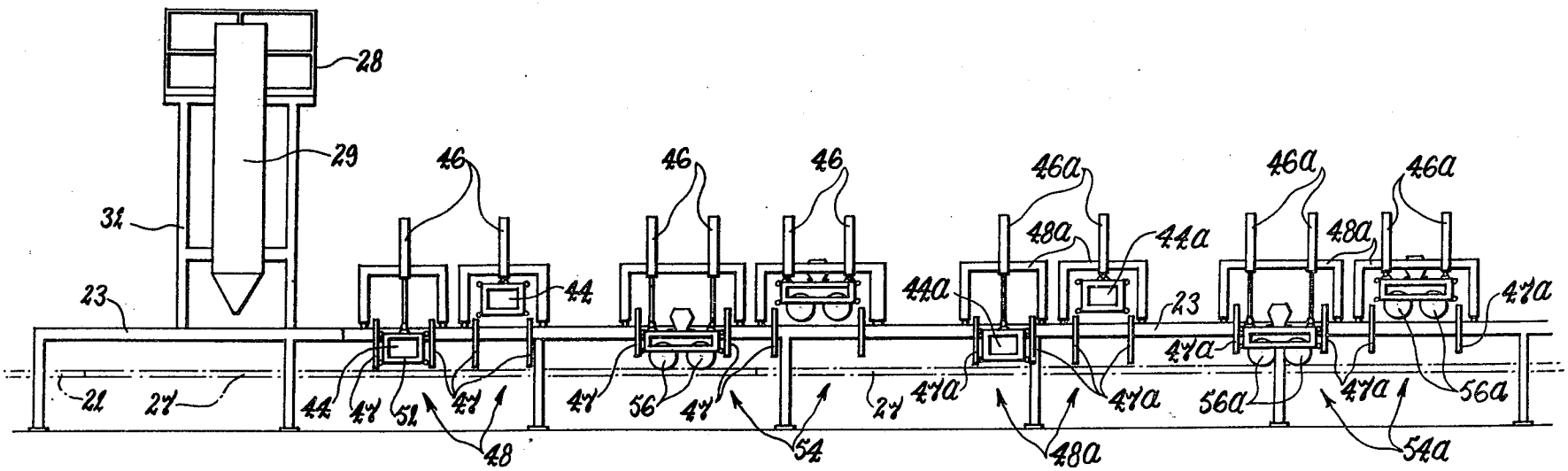
FIGS. 5 and 6 are elevational and plan views respectively of the casting and fibre impregnation sections of a reinforced plaster sheet manufacturing plant according to the invention.
Figure 6:
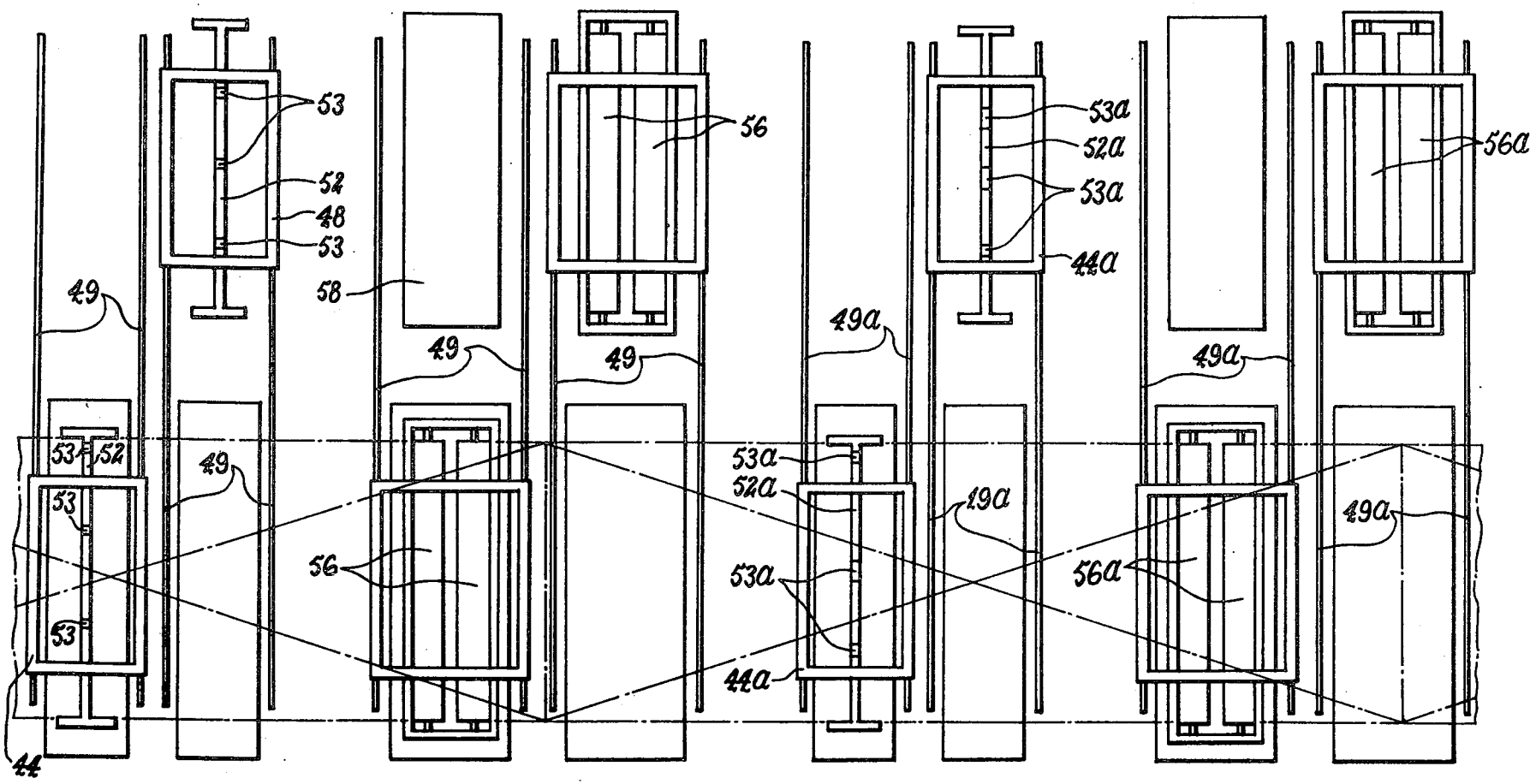
Figure 7:
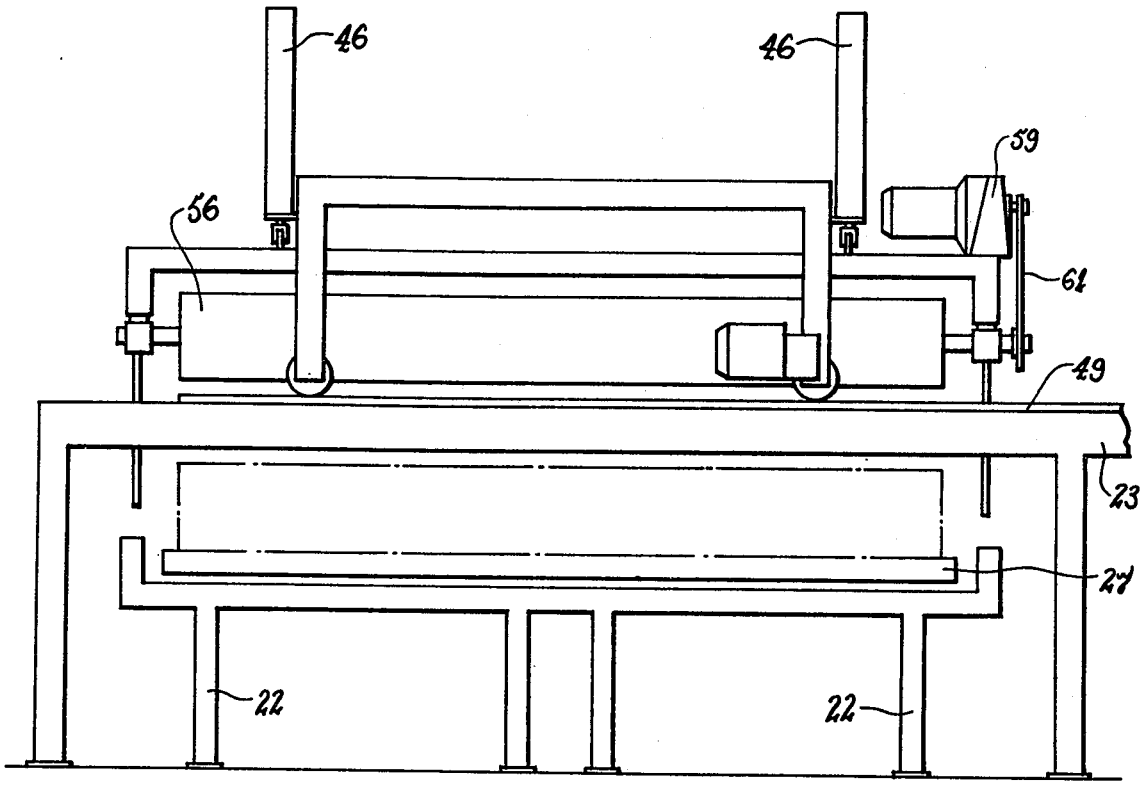
FIGS. 7 and 8 are enlarged elevational and plan views respectively of an apparatus for rolling fibres into the slurry.
Figure 8:
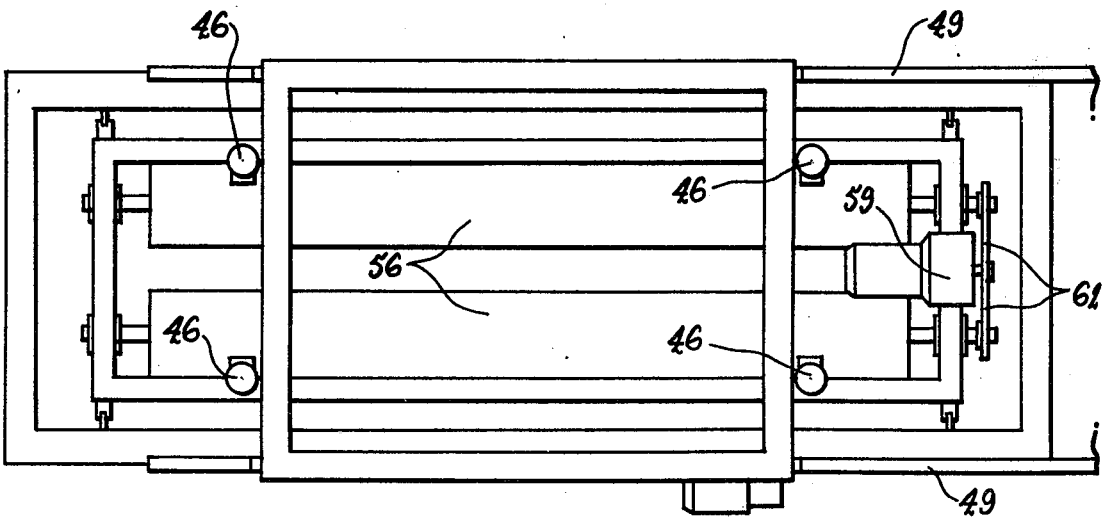

The preferred apparatus includes a continuous conveyor to carry a mould train. The conveyor is preferably comprised by a substantially horizontal forward track 21 (shown in FIGS. 5 and 11). The forward track may be provided by a supporting frame 22 (FIGS. 1 and 7), preferably within an access platform 23 (FIGS. 5 and 7).

The preferred conveyor also includes a mould accelerator and indexing arrangement 24 (FIG. 11) to move the lead mould apart from the mould following and move it to a return track whilst maintaining it substantially horizontal. Preferably the return track (not shown) is located beneath the forward track 21, so the indexing arrangement is in the form of a descender. It will be appreciated that the moulds are first moved apart so that they do not foul during indexing. A similar accelerator and indexing arrangement 26 (FIG. 11) preferably provided at the other end of the conveyor to raise the moulds to the forward track 21 from the return track.

The individual moulds 27 include a substantially flat mould floor and a pair of upstanding side walls of the height desired for the plaster sheet. The moulds do not have end walls so that when the moulds are placed end to end in a mould train an endless sheet may be cast. The adjacent moulds are preferably bridged by strip preferably of rubber or other suitable material—about ¼ inch wide for example. Preferably one side wall is removable, such as by hinging outwards to facilitate removal of the cast sheet as further discussed below.

Referring to FIGS. 1 to 4, the preferred apparatus for mixing a plaster/water slurry 28 comprises a mixing area preferably in the form of a vertically disposed tube 29 which is mounted on a supporting frame 31. Water supply means in the form of a pipe 32 are also mounted on the structure 31 alongside the length of the mixing tube 29. A large number of branch pipes 33 which encircle the tube 29 are connected to main pipe 32 and provide a supply of water to a number of spray nozzles 34 connecting with the interior of the tube 29. Preferably eight nozzles are equally spaced around each branch pipe 33 and the relative position of the nozzles on the succeeding branch pipes is slightly staggered so as to give a spiralling appearance to the nozzle positioning as one looks down the tube 29.

Preferably the bottom of the tube 29 tapers at 36 down to a feeder tube 37 which supplies a horizontally extending distribution pipe 38 with slurry for casting into the moulds 27. The distribution pipe 38 is provided with a number of openings for feeding plaster slurry at an even rate across the width of the mould. In order to ensure that the slurry has a consistent composition a motorised mixer 39 may be mounted on the tapered portion 36 and is designed such that a mixing propeller 41 which is driven via drive shaft 42 projects into the central portion of the mixing tube.

During operation of the mixing apparatus dry plaster is fed into the tube 29 at a metered rate. For example the plaster may be fed from a storage silo by a screw conveyor into an in-line weigh feeder which accurately weighs out and feeds a set weight of plaster per unit time into the top of the tube 29. As the plaster gravitates through the tube it becomes thorougly wetted by spray from the arrangement of spray nozzles 34. Water supply to the nozzles is preferably achieved through the pipes 32 and 33 from a roof tank at a metered rate and the pressure of water supplied to the lowest nozzle is of the order of 10 psi. Process control additives may be metered into the main water pipe 6 from separate tanks as required. After wetting, the plaster slurry settles at a substantially constant level 43 (FIG. 1) near the bottom of the tube 29 and the continuous mixing action of the mixer ensures that the slurry has a constant composition. The mixer also has the effect of preventing build up and hardening of the slurry around the tapered portion 36.

At the same time plaster slurry from the mixing tube 29 continuously feeds out from the distribution pipe 38 into moulds 27. As the moulds continuously move along the conveyor tables 22 beneath the distribution pipe at a calculated and fixed rate the flow of plaster slurry from the mixing tank does not have to be interrupted at any stage of the casting.

Referring now to FIGS. 5 to 9, moulds 27 on leaving the slurry mixing and casting area move along the conveyor tables 22 until the run beneath the first set of fibre disposal means 44. Generally the moulds will be so long (of the order of 30' in length) that one end of the mould will be at the slurry mixing and casting area while the other end will be under the fibre disposal and rolling area.

At the fibre disposal area, the disposal means 44 may be mounted in such a way that it can be raised or lowered by a hydraulic cylinder 46 which may be electrically activated by an operator. The disposal means is preferably adapted to run along vertical runners 47 to ensure accurate placement. In addition the disposal means and associated hydraulic gear, generally designated 48 may run along the horizontal runners 49 which rest on the access platform 23.

The apparatus 48 is preferably duplicated so that one of the disposal means may be vertically raised and horizontally moved away from the operating process along runners 49 for servicing and refilling with fibres while the other disposal means remains operating. In this way down-time of the plant due to breakdowns can be minimised. The fibre disposal means 44 is preferably designed to evenly dispose sisal or fibreglass in the form of individual randomly oriented lengths, continuous meandering strands or a random mat over the surface of the slurry.

The fibre disposal means 44 illustrated in the drawings is designed to randomly disperse chopped glass fibre strands across the slurry surface. The means 44 is preferably comprised of a frame 51 on which is mounted a guide rail 52 having three motorised fibre chopping and distributing sections 53. Each of the sections 53 automatically moves back and forth along the length of the guide 52 while at the same time chopping lengths of glass fibre from a glass fibre supply reel and allowing the lengths to drop onto the surface of the plaster slurry in the mould moving along the conveyor tables below. Preferably a means for producing a fish-tail oscillating air stream also move with the choppers and direct a stream of turbulent air at the falling fibres to ensure completely random placement and directionality of the fibres as they fall to the surface of the plaster slurry.

Figure 9:
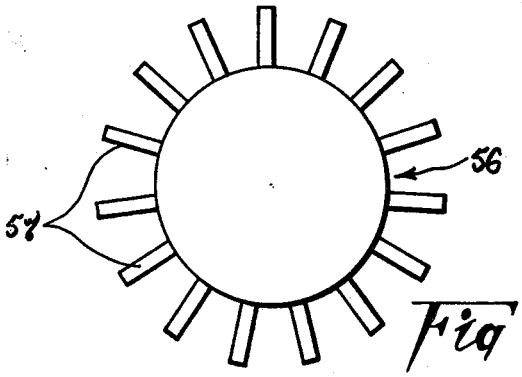
FIG. 9 shows a cross-section of a fluted roller for rolling fibres into the slurry.

Chopped fibres are rolled into the plaster slurry by the first rolling section 54 which is adapted to be raised or lowered into position or moved horizontally out of position using an arrangement similar to that for the first fibre disposal means 44. The only major factor of difference between the preferred positioning apparatus of the fibre disposal means and the preferred rolling section being the provision of two electrically activated hydraulic cylinders 46 instead of the one cylinder which is used to raise and lower the fibre disposal means. Preferably rolling section 54 is also duplicated to aid servicing and minimise down-time of the plant. In the preferred roller section 54 a pair of rollers 56 are provided each including a plurality of flutes 57 (FIG. 9). Preferably the flutes are of a pitch of about 1 inch around the roller circumference and each extends along the length thereof. During rolling, the flutes force the chopped glass fibres deep into the slurry such that the major proportion of the fibre resides in a fibre layer near the region of the bottom of the slurry. The first rolling section 54 also includes a dipping tank 58 at the side of the forward track 21 which is used to periodically remove built up plaster from each of the rollers. The section 54 preferably includes means in the form of a motor 59 and associated belt and pulley arrangement 61 to drive the rollers 56 when in the tank 58. The roller is then returned to the slurry surface and the alternate roller is cleaned by dunking it in the tank 58.

After the first batch of glass fibre has been rolled into the plaster the process of chopping and rolling is repeated by almost identical apparatus, the numbers identifying the various components of the second chopping and rolling section having the suffix A. Preferably the basic difference between the first and second chopping and rolling sections lies in the provision of rollers 56a having an open mesh surface to allow rolling of the second batch of glass fibre into the plaster slurry in the layer near to or adjacent the upper surface of the slurry. Preferably the mesh provides about 62% open area.

The mould containing plaster slurry which has been reinforced with two layers of glass fibre then preferably passes through an edge wiping device 62 (FIG. 11) for pushing any slurry which has collected on the top of the sides of the mould back into the mould. This device (not shown in detail) may comprise a pair of driven horizontal rubber discs having teeth or fins around their periphery. These discs are disposed such that they touch the top of each side of the mould. When the discs rotate in a horizontal plane the teeth or fins on the disc push plaster slurry which has been spilt on the sides of the mould back into the mould.

Figure 10:
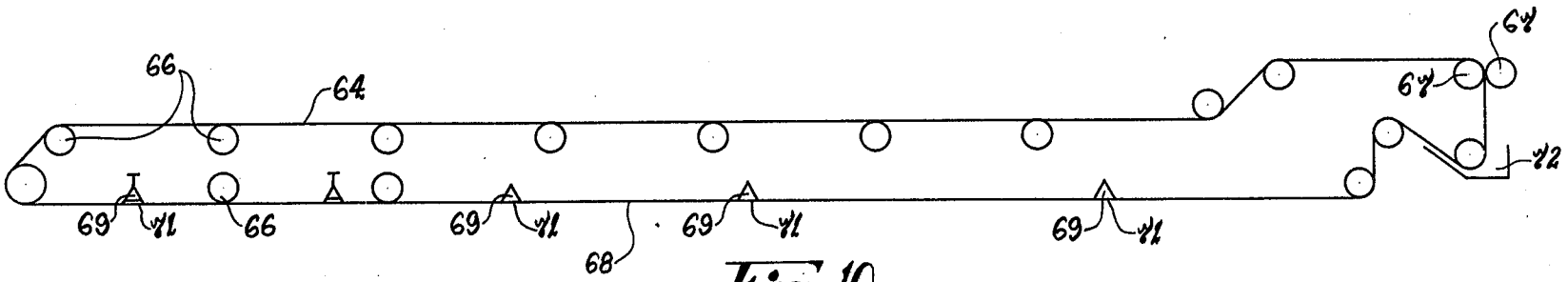
FIG. 10 illustrates a preferred apparatus for obtaining a smooth surface on the upper face of the plaster slurry.

On leaving the device 62 the upper surface of the plaster slurry is preferably smoothed and levelled by a levelling apparatus generally designated 63 and shown in FIG. 10. The levelling apparatus may comprise an endless plastic coated rubber sheet 64 which is fed around a number of idler rollers 66 and drive rollers 67. The lower under surface of the sheet 68 is in continuous contact with the upper surface of the plaster slurry in the moulds for a distance of about 100 feet. A number of thickness control devices 69 are held against the lower length of rubber sheet to ensure that the height of the sheet relative to the slurry is kept substantially constant. These devices 69 may each consist of a flat smooth surface sheet 71 such as plate glass which is rigidly held in horizontal contact with the rubber sheet. The height of the control device 69 is preferably adjustable. A washing tank 72 filled with water is provided at one end of the levelling apparatus for washing off any plaster which clings to the rubber sheet 64.

The apparatus also includes a mould separator unit shown generally at 73 (FIG. 11) which preferably consists of a vertically movably blade adapted to cut between adjacent moulds as they pass to cut through to the joining strip.

Figure 11:
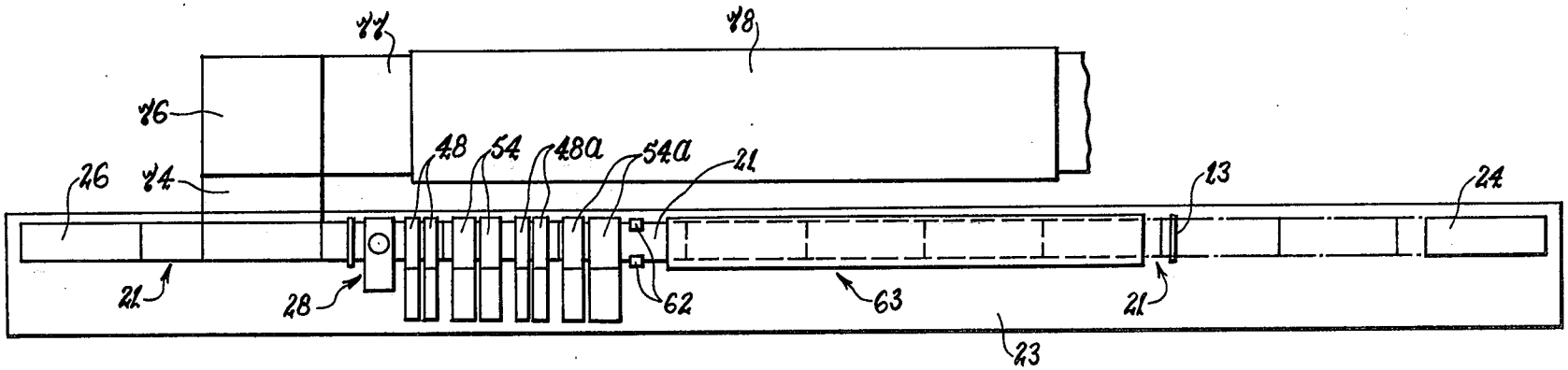
FIG. 11 shows in plan the basic components of preferred apparatus for manufacturing sheets according to the invention.

The apparatus also includes demoulding means shown generally at 74 (FIG. 11). Preferably the demoulding means is located subsequent to the ascender 26. The demoulding means 74 preferably includes means to rotate a side wall of the mould outwardly and air blasting means to direct a blast of air at the junction between the cast sheet and the mould floor to assist in the release of the cast sheet from the mould. Preferably vacuum demoulding means are provided in the form of one or more vacuum cups adapted to be placed on the upper surface of the cast sheet to lift it from the mould and transfer it to a drying apparatus adjacent the apparatus.

The outline of the overall manufacturing process will now be given with particular reference to FIG. 11 and with more general reference to the other drawings.

Plaster, water and additives are mixed in the mixing apparatus and the resultant slurry is continuously passed into the mould train 27 travelling below to provide an endless length of slurry. A decorative facing sheet may be laid at the bottom of each mould, prior to casting of the slurry if a decorative facing for the plaster is required. The cast plaster slurry is then levelled and the moulds continue along conveyor tables 21 passing under fibreglass disposal means 44 which cuts the glass fibre strands to length and evenly deposits them in random orientation across the plaster slurry surface.

As the mould train 27 moves further along the conveyor tables roller means 54 forces the fibreglass strands through the plaster slurry to form a fibre layer in the slurry adjacent the bottom of the mould. The mould train 27 continues on to fibre disposal means 44*a* which randomly deposits a further amount of chopped fibre strand and the rolling process is repeated with roller means 54*a* which forces the chopped strands into the slurry to form a layer of reinforcing fibre immediately beneath the upper surface of the slurry. Subsequently an edge wiper 62 forces slurry which has spilt on both sides of the mould back into the mould. The mould then passes under sheet levelling apparatus 68 which smooths the upper surface of the plaster slurry and ensures that its thickness is uniform across the length and breadth of the mould.

After levelling, a mould separator 73 as above described cuts the slurry, which by now has had sufficient time to set into rigid sheets, to size. The cut sheets supported by the moulds then pass onto a descender 24 which lowers the moulds to a return track preferably below the level on which the processing of the plaster sheets has so far occurred.

The moulds after the descent reverse along their original path on a new level during which time the sheets develop sufficient wet compressive strength to allow removal from the mould without damage in the demoulding means 74 above described. Preferably to vacuum demoulding means automatically passes the individual sheets into vertical racks on a drier loading area 76. The empty moulds are then sprayed with a release agent to be recycled to receive a further amount of slurry. Simultaneously the preferred motorised rack automatically moves the sheets which have been removed from the moulds through a buffer zone 77 into a drier 78.

Thus it will be seen that the present invention provides for the continuous manufacture of plaster sheet in an economic manner, reducing the man hour involvement substantially. It will be appreciated of course that various minor modifications, additions and variations may be made to the construction and arrangement of parts described without departing from the ambit of the invention defined in the claims that follow.

Having now described my invention, what I claim as new and desire to secure by Letters Patent is:

1. Apparatus for the continuous manufacture of fibre reinforced plaster sheet, including:

a plurality of sheet casting moulds;

endless conveying means supporting said moulds;

a casting station having slurry casting means for casting slurry into said moulds as they pass;

a fibre station, having fibre disposing means for disposing reinforcing fibres across the surface of the cast slurry and fibre forcing means to force the fibres into the slurry; and sheet removing means for removing cast sheets from the moulds.

2. Apparatus as clamed in claim 1, wherein said fibre forcing means is provided by a slurry roller adapted to roll the surface of the slurry.

3. Apparatus as claimed in claim 2, wherein said slurry roller is provided with a plurality of radially extending fibre engaging extensions to force the fibres to a zone within the slurry at or adjacent the lower surface thereof.

4. Apparatus as claimed in claim 3 wherein a pair of such slurry rollers are provided.

5. Apparatus as claimed in claim 3, wherein said fibre station includes a second fibre disposing means for disposing a second batch of reinforcing fibres across the surface of the slurry after the first batch has been forced to the lower zone, and an associated slurry roller to force the second batch of fibres to a zone within the slurry at or adjacent the upper surface thereof.

6. Apparatus as claimed in claim 5, wherein said associated roller has an open mesh rolling surface.

7. Apparatus as claimed in claim 5, wherein a pair of said associated rollers are provided.

8. Apparatus as claimed in claim 1, wherein fibre disposing means and said fibre forcing means are duplicated and movable to the side for maintenance and cleaning during the continuous operation of the apparatus.

9. Apparatus for the continuous manufacture of fibre reinforced plaster sheet, including:

a plurality of sheet casting moulds each having a mould floor and a pair of side walls, adjacent moulds being joined by a flexible strip whereby to form a mould train for the casting of a continuous sheet of plaster;

a casting station having slurry casting means to cast slurry into the mould train;

a fibre station, having fibre disposing means for disposing reinforcing fibres across the surface of the cast slurry and fibre forcing means to force the fibres into the slurry;

separator means to cut the plaster sheet at the flexible strip, and sheet removing means for removing the cut plaster sheets from the moulds.

10. Apparatus as claimed in claim 9 including, mould accellerator means to move the moulds apart after they pass said separator means; and indexing means to move the separated moulds to a return track whilst maintaining the mould floor substantially horizontal.

11. Apparatus as claimed in claim 10, including a second mould accellerator means and indexing means to remove the moulds from the return track and place them into position for further casting.

12. Apparatus as claimed in claim 9 wherein a side wall of said mould is movable and wherein said sheet removing means includes air blasting means to direct a blast of compressed air between the cast sheet and the mould floor, and vacuum demoulding means whereby to lift the cast sheet from the mould.

13. Apparatus as claimed in claim 9, including located between the fibre station and the separator means, a levelling means having an endless levelling sheet in continuous contact with the upper surface of the slurry.

* * * * *